United States Patent [19]

Atwood et al.

[11] 3,964,576

[45] June 22, 1976

[54] LUBRICATION BLOCK AND SYSTEM FOR SPINNING AND TWISTING RINGS

[75] Inventors: Hyatt B. Atwood, Buffalo; James N. McLean, Tonawanda, both of N.Y.

[73] Assignee: Herr Manufacturing Company, Inc., Tonawanda, N.Y.

[22] Filed: Sept. 9, 1974

[21] Appl. No.: 504,343

[52] U.S. Cl. ..... 184/7 A; 57/120

[51] Int. Cl.[2] ..... D01H 7/62

[58] Field of Search ..... 184/81, 7 A; 57/120

[56] References Cited

UNITED STATES PATENTS

| | | | |
|---|---|---|---|
| 2,867,076 | 1/1959 | Atwood | 184/7 A |
| 3,112,603 | 12/1963 | Atwood | 57/120 |
| 3,416,303 | 12/1968 | Atwood | 57/120 |
| 3,603,070 | 9/1971 | Atwood | 184/7 A |
| 3,669,219 | 6/1972 | Wayson | 184/7 A |

*Primary Examiner*—Richard C. Pinkham
*Assistant Examiner*—Marvin Siskind
*Attorney, Agent, or Firm*—Joseph P. Gastel

[57] ABSTRACT

A spinning and twisting ring construction comprising a rail, a holder secured to said rail and mounting a spinning ring, a lubricant block including a lubricant feeder therein secured directly to said holder in lubricant conducting relationship, and a conduit in said holder for conducting lubricant from said lubricant block to said spinning ring.

22 Claims, 6 Drawing Figures

Fig. 4.
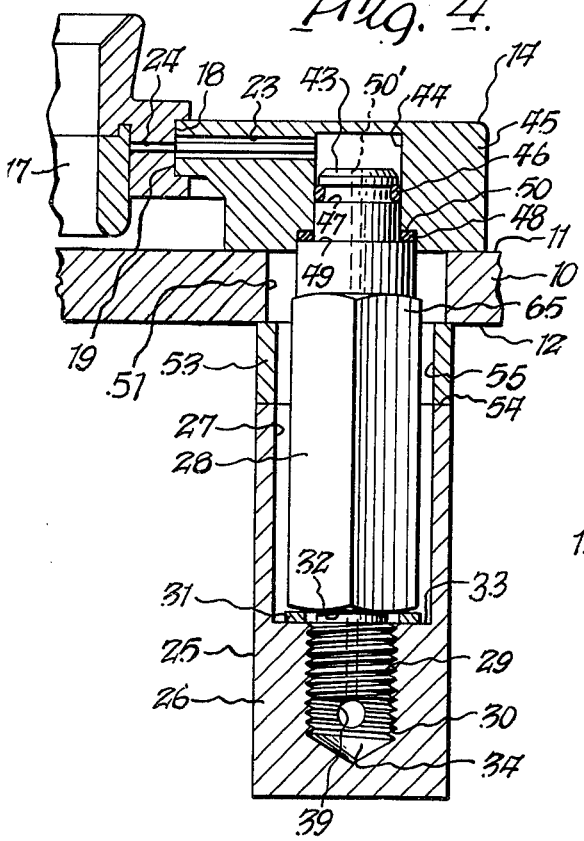
Fig. 5.
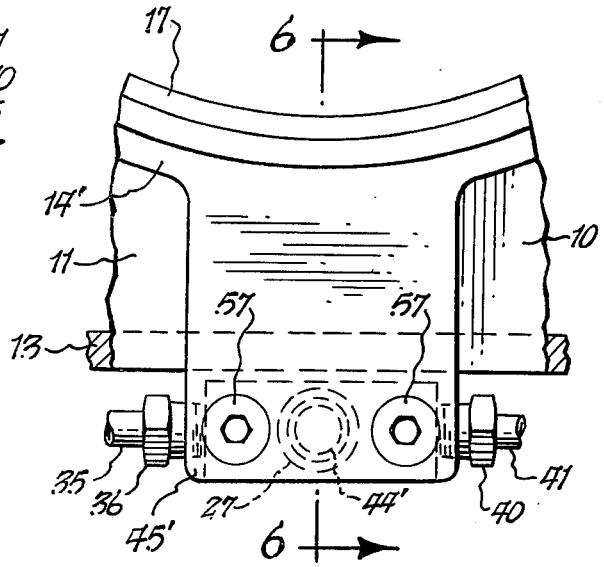
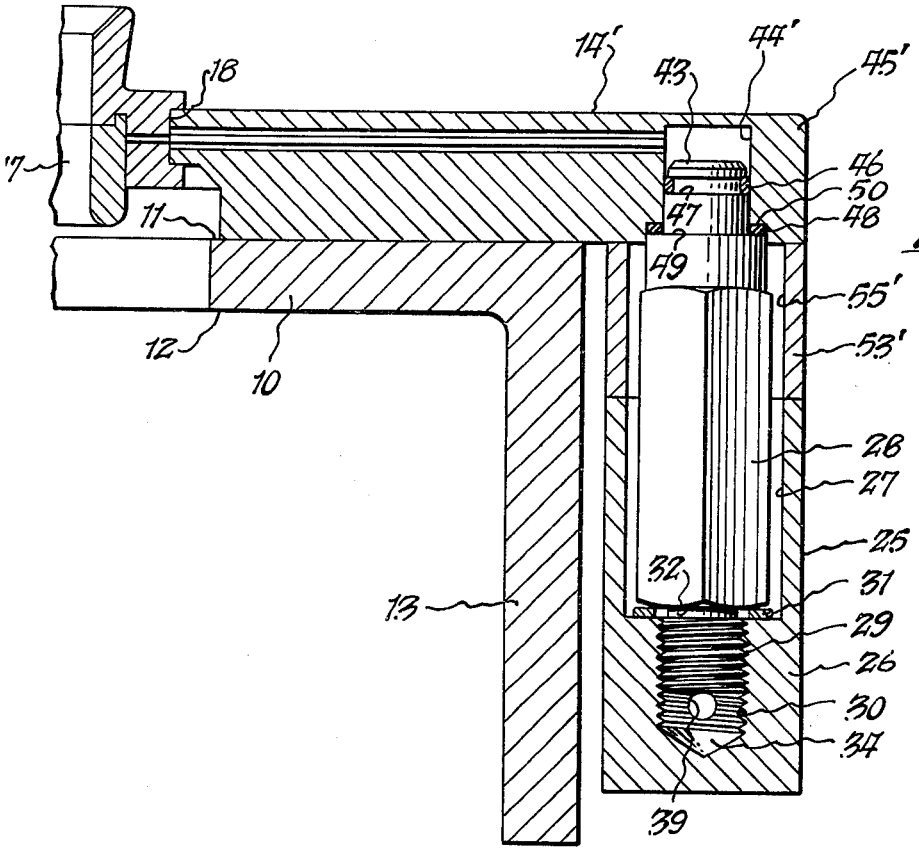
Fig. 6.

LUBRICATION BLOCK AND SYSTEM FOR SPINNING AND TWISTING RINGS

The present invention relates to an improved spinning and twisting ring lubrication system and to a lubricant block therefor.

By way of background, in the operation of spinning and twisting rings, lubricant is usually supplied thereto through relatively fragile tubes called "tail tubes." These tubes are subject to breakage in a number of ways. First of all, in the event that the thread should break, the flying thread may engage and rupture the tail tubes. Secondly, lint and other foreign debris tends to accumulate on the tail tubes and many times the tail tubes are ruptured during the process of cleaning this material therefrom. When a tail tube is ruptured, the ring will not get any lubrication and the increased tension on the traveller will cause a variation in yarn tension and will result in a broken end, which is very undesirable. The replacement of tail tubes is relatively difficult and time consuming and therefore constitutes an inconvenience.

It is accordingly one object of the present invention to provide an improved spinning and twisting ring lubrication system which is relatively sturdy and therefore is not subject to breakage due to flying thread or incidental to cleaning lint and debris therefrom.

Another object of the present invention is to provide an improved lubricant feed block for spinning and twisting rings which can be installed quickly and easily.

Another object of the present invention is to provide an improved lubricant block for a spinning and twisting ring which can be installed essentially by a quick plug-in type of arrangement thereby obviating the effort and time required to install prior types of lubricant feed arrangements. Other objects and attendant advantages of the present invention will readily be perceived hereafter.

The improved spinning or twisting ring system comprises a rail, a holder, means for securing said holder to said rail, a spinning ring mounted on said holder, a lubrication block including a lubricant feeder therein, means for conducting lubricant to said lubricant block, securing means for securing said lubricant block directly to said holder in lubricant-conducting relationship, and conduit means in said holder for conducting lubricant from said lubricant block to said spinning ring.

The present invention also relates to a lubricant block for a spinning or twisting ring comprising a body portion, a chamber in said body portion, a lubricant feeder, means for securing said lubricant feeder in said body portion with a portion of said lubricant feeder extending outwardly beyond said body portion, conduit means in said block for conducting lubricant from an external source to said lubricant feeder, and seal means between said conduit means and said lubricant feeder to prevent leakage of lubricant therebetween. The various aspects of the present invention will be more fully understood when the following portions of the specification are read in conjunction with the accompanying drawings wherein:

FIG. 4 is a fragmentary cross sectional view taken substantially along line 4—4 of FIG. 3;

FIG. 5 is a fragmentary plan view of a modified embodiment of the present invention having a modified holder for supporting the lubrication block outside of the rail; and FIG. 6 is a fragmentary cross sectional view taken substantially along line 6—6 of FIG. 5.

Figure 1:
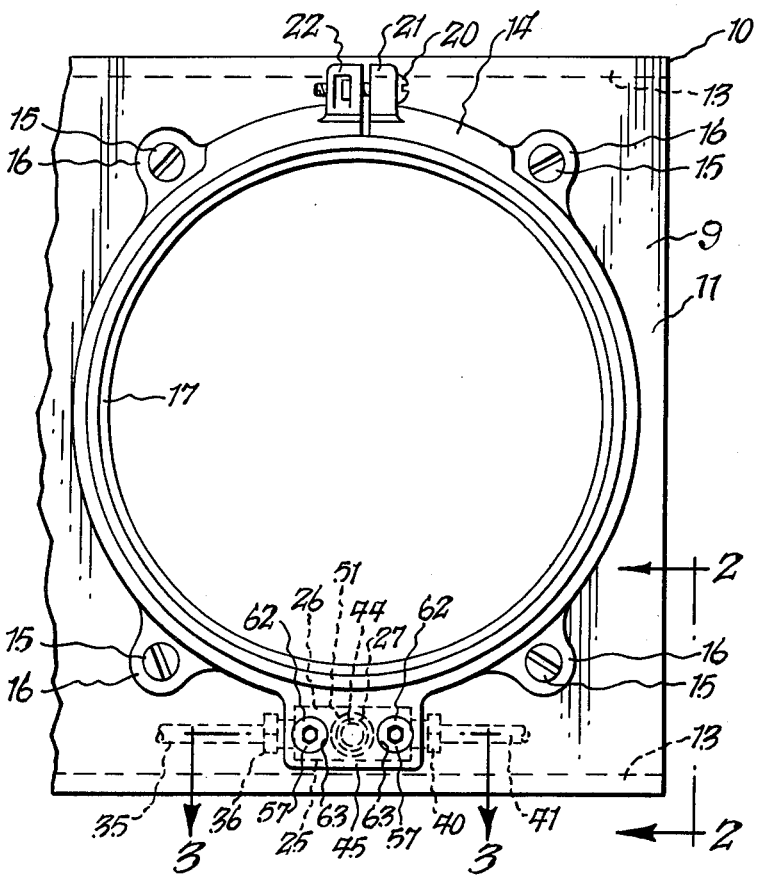
FIG. 1 is a fragmentary plan view of a rail mounting a ring, a holder and the improved lubrication block of the present invention.
Figure 2:
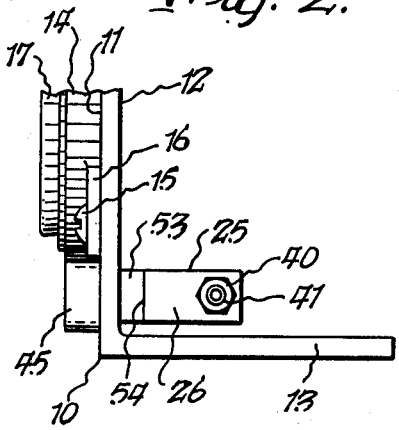
FIG. 2 is a fragmentary side elevational view taken substantially along line 2—2 of FIG. 1.
Figure 3:
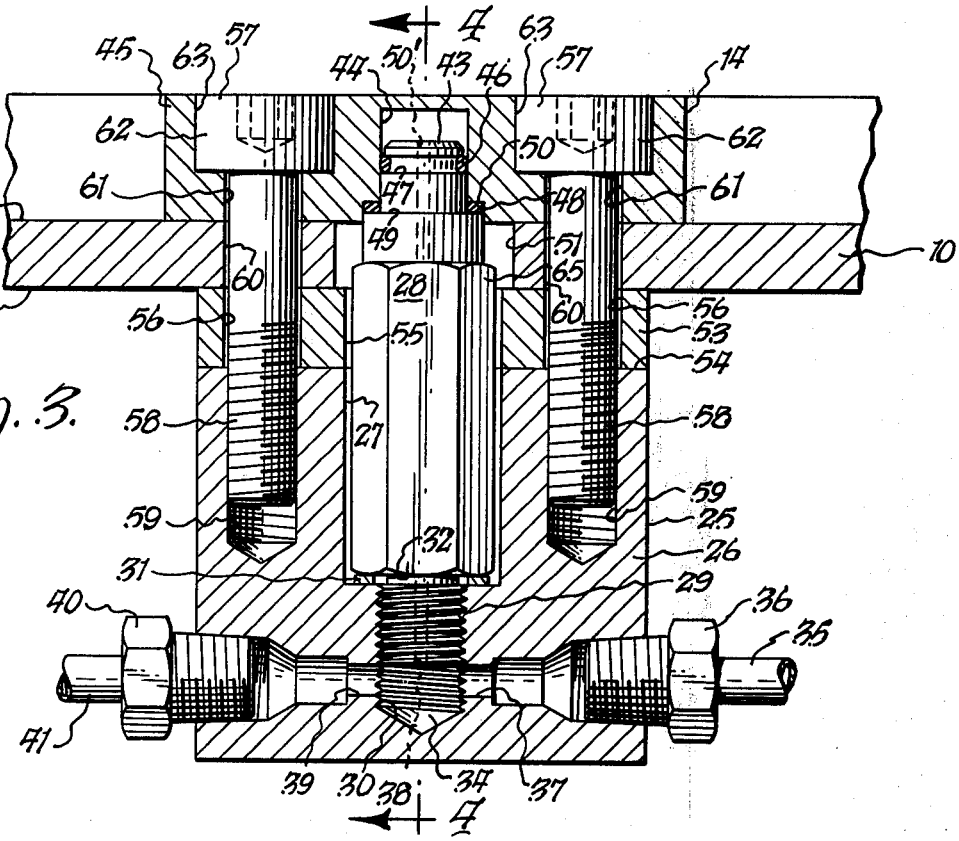
FIG. 3 is a fragmentary cross sectional view taken substantially along line 3—3 of FIG. 1 and showing the assembled relationship between the lubrication block, rail and holder.

In the embodiment of FIGS. 1–4 a ring rail 10 is provided having a central portion 9 having an upper surface 11 and a lower surface 12, with downwardly depending flanges 13 extending from central portion 9. Ring rail 10 mounts a plurality of ring holders 14, only one being shown. However, it will be understood that each ring rail 10 may mount six or more holders such as 14 and that a plurality of ring rails 10 are aligned along the spinning or twisting machine. Each holder 14 is secured to rail 10 by a plurality of screws 15 which extend through ears 16 of the holder.

A spinning or twisting ring 17 which may be of any conventional construction includes an outer annular groove 18 (FIG. 4) which receives the inner annular edge portion 19 of holder 14. Spinning ring 17 is secured in position when screw 20, which extends through spaced tabs 21 and 22 of holder 14, is tightened. It is to be noted at this time that a lubricant conduit 23 (FIG. 4) is provided in holder 14, and conduit 23 is positioned in alignment with lubricant conduit 24 of ring 17. Suitable sealant is provided at the junction of conduits 23 and 24 to prevent leakage. Any suitable conduit system may be provided in ring 17 to provide proper lubrication to the surfaces thereof, and a suitable conduit system which may be used is shown in U.S. Pat. No. 3,831,367.

In the past, the conventional way of conducting lubricant to ring 17 was through a very fine tube called a "tail tube" which extended between holder 14 and a lubricant feeder secured to flange 13. However, this tail tube tended to accumulate lint and other debris and when an attempt was made to remove such debris, very often the tail tube was broken. In addition, the tail tube was subject to breakage from a flying thread which may have broken during the spinning or twisting operation. In addition, whenever tail tubes had to be replaced or repaired, a relatively complex operation had to be performed.

In accordance with the present invention, a lubricant block 25 is provided for the purpose of providing lubricant to ring 17, and this block obviates the above enumerated shortcomings of "tail tubes." Lubricant block 25 includes a body portion 26 which has a cylindrical bore 27 therein to receive a lubricant feeder 28, which may be of any conventional type available in the art for metering lubricant therethrough. Lubricant feeder 28 has a hexagonal outer configuration and it fits satisfactorily into bore 27. The threaded lower portion 29 of feeder 28 is received in threaded relationship in tapped bore 30 of body portion 26. A sealing gasket 31 is interposed between surface 33 of block 25 and surface 32 of feeder 28. Lubricant is supplied to chamber 34 in block 25 from conduit 35 which is attached to fitting 36 which in turn is installed in block 25 in fluid tight relationship. The lubricant leaving fitting 36 passes through conduit 37 before entering chamber 34. Lubricant which does not enter feeder 28 through bore 38 in feeder portion 29 will pass into conduit 39 in block 25, through fitting 40 and thence through conduit 41 and thus be conducted to the next adjacent lubricant block 26 associated with an adjacent spinning ring. The lubricant which passes through feeder 28 leaves it through conduit 50' and enters the chamber defined by bore 44 from which it enters bore 23 in holder portion 45. It will be understood that there is one lubricant block 25 associated with each spinning ring 17 and each block is assembled relative to the rail, holder and spinning ring in the same manner as lubricant block 25 depicted in the drawings.

In order to install lubricant block 25 into operative relationship with the remainder of the assembly, the upper reduced tip 43 of feeder 28 is plugged into bore 44 of holder portion 45. A first O-ring 46, which is located in groove 47 of tip 43, forms a seal with the wall of bore 44. A second O-ring 48 forms a seal between annular shoulder 49 of feeder 28 and annular shoulder 50 adjacent bore 44. It will be noted that a portion of lubricant feeder 28 is located in oversized cylindrical aperture 51 in rail 10. Because of the presence of oversized bore 51, it will be appreciated that there can be a certain tolerance in the alignment of holder 14 on rail 10 without interfering with a proper fitting connection between holder portion 45 and the upper tip of feeder 28.

Before the upper end of feeder 28 is plugged in, a spacer 53 is inserted between the undersurface 12 of rail 10 and the upper surface 54 of block 25. Spacer 53 is a separate member of rectangular solid configuration and includes an oversized central cylindrical aperture 55 for receiving a portion of feeder 28 and a pair of spaced oversized cylindrical apertures 56 for receiving screws 57 which have their lower portions 58 threaded into mating tapped bores 59 of block 25 and which also extend through oversized bores 60 in rail 10 and through oversized bores 61 in portion 45 of holder 14. The heads 62 of screws 57 are received in counterbores 63 of holder portion 45.

Spacer 53 performs a plurality of functions. First of all, it takes up the space between upper surface 54 of block 25 and undersurface 12 of rail 10. Its thickness can easily be varied to accommodate the different ring rail thicknesses which may vary from ⅛ inch to 5/16 inch on different types of machines, and thus a standard block may be used for all types of installations. Thus, the area occupied by the spacer, being completely filled in, cannot be the focal point for the accumulation of lint, debris and other undesired matter. In addition, when spacer 53 is removed from contiguous relationship with block 25, the upper portion 65 of feeder body 28 will be exposed so that a wrench can be applied to the hexagonal outer surface thereof to permit it to be unthreaded from block 25 at 28–29. It will be appreciated that if spacer 53 were not used and it was still desired to fill in the space occupied by spacer 53 by enlarging body portion 26, the latter would have to be much larger so as to permit a wrench to be inserted into an enlarged bore at 55, to permit removal of lubricant feeder 28 from block 25.

It can thus be seen that the above described installation not only permits fast plug-in replacement of a lubricant feeder after screws 57 are loosened, but also causes the lubricant block 25 to be held solidly against the ring rail. Because of this sturdy construction, the lubricant feeder block cannot be pulled off by flying thread or dislodged when foreign materials and debris are removed from the outside of block 25. In addition, because of the oversized aperture 51 and oversized apertures 60 of ring rail 10 and further because of the over-sized apertures 55 and 56 in spacer 53 and oversized apertures 61 in holder portion 45, there is a desirable tolerance to permit satisfactory assembly of the various parts without the requirement for extremely precise alignment.

A modified embodiment of the present invention is shown in FIGS. 5 and 6. This embodiment incorporates all of the same general basic features discussed above relative to FIGS. 1–4 except that the lubricant block 25, which is identical to block 25 of FIGS. 1–4, is mounted outside of ring rail 10 rather than underneath it. To achieve this result, portion 45' of holder 14' is made longer than portion 45 of holder 14. This permits block 25 to be attached to portion 45' in the manner shown in FIGS. 5 and 6. More specifically, screws 57, which may be identical to screws 57 of FIGS. 1–4, extend through holder portion 45' and are received in tapped apertures 59 (FIG. 3) in block 25. The upper portion of lubricant feeder 28 is received in bore 44' of portion 45' in an identical manner as described above relative to FIG. 3. The only difference between the embodiment of FIGS. 5–7 and FIGS. 1–4, aside from the dimensions of holder portion 45', is in the use of a spacer 53' which is much thicker than spacer 53 of FIG. 3. Actually spacer 53' is equal to the thickness of spacer 53 plus the thickness of rail 10, because rail 10 is not sandwiched between the block 25 and holder portion 45'. Because of the foregoing dimensioning of spacer 53', a block 25 of the same dimensions used with the installation of FIGS. 1–4 can be used in the installation of FIGS. 5 and 6. It will be appreciated that the dimensions and construction of spacer 53' other than the thickness is identical to the dimensions and construction of spacer 53. All numerals of FIGS. 5 and 6 which are identical to the numerals of FIGS. 1–4 represent identical structure. All primed numerals of FIGS. 5 and 6 represent structure which is analogous to the structure represented by unprimed numerals of FIGS. 1–4.

The installation of FIGS. 5–6 is a rigid one which permits rapid replacement of the lubricant blocks by means of a plug-in and screw attachment and also provides a very rigid installation which cannot be injured by flying thread or during the cleaning of lint and debris therefrom.

It can thus be seen that the improved spinning and twisting ring system and lubrication block are manifestly capable of achieving the above enumerated objects and while a preferred embodiment has been disclosed, it will be understood that the present invention is not limited thereto but may be otherwise embodied within the scope of the following claims.

What is claimed is:

1. A spinning ring system comprising a rail, a plurality of holders, means mounting said holders on said rail, a spinning ring mounted on each of said holders, individual lubricant block means for each of said holders including lubricant feeder means in each of said lubricant block means for metering lubricant to a respective spinning ring, first conduit means in each of said individual lubricant block means for conducting lubricant into said lubricant block means and to said lubricant feeder means, securing means for securing each of said individual lubricant block means directly to a respective holder in lubricant-conducting relationship, second conduit means in each of said holders for conducting lubricant from each of said lubricant feeder means therein to a respective spinning ring, and third conduit means for conducting lubricant to said first conduit means from a lubricant source.

2. A spinning ring system as set forth in claim 1 including a plug-in connection between each of said lubricant block means and a respective holder.

3. A spinning ring system as set forth in claim 2 wherein said securing means includes screw means for attaching each of said lubricant block means to a respective holder.

4. A spinning ring system as set forth in claim 2 including spacer means located between each of said lubricant block means and a respective holder.

5. A spinning ring system as set forth in claim 4 wherein said spacer means exposes a portion of said lubricant feeder means when said spacer means is removed from said lubricant block means.

6. A spinning ring system as set forth in claim 5 wherein each of said lubricant block means is mounted in contiguous relationship to the underside of said rail, and wherein said spacer means is located between each of said lubricant block means and said underside of said rail, and wherein a portion of each of said lubricant feeder means extends through said rail.

7. A spinning ring system as set forth in claim 6 wherein said rail includes oversized apertures to receive said portions of said feeder means which extend through said rail.

8. A spinning ring system as set forth in claim 5 wherein each of said lubricant block means is located externally of said rail.

9. A spinning ring system as set forth in claim 2 wherein said plug-in connection is between each of said lubricant feeder means and said holder.

10. A spinning ring system as set forth in claim 1 wherein said each of said holders includes a holder portion which extends beyond said rail, and wherein said securing means secure each of said lubricant block means to a respective holder externally of said rail.

11. A spinning ring system as set forth in claim 10 including spacer means located between each of said lubricant block means and a respective holder.

12. A spinning ring system as set forth in claim 10 including a plug-in connection between said lubricant block means and a respective holder.

13. A spinning ring system as set forth in claim 12 wherein said plug-in connection is between each of said lubricant feeder means and said holder.

14. A spinning ring system as set forth in claim 13 wherein said plug-in connection comprises a straight plug-in connection.

15. A spinning ring system as set forth in claim 1 including spacer means located between each of said lubricant block means and said holder.

16. A spinning ring system as set forth in claim 1 wherein each of said lubricant feeder means includes first and second end portions, and wherein said first end portion is received in a respective holder, and wherein each of said lubricant block means includes a body portion, a bore in each of said body portions, said second end portions of each of said lubricant feeder means being located in each of said bores, and seal means effectively positioned between each of said first end portions and a respective holder.

17. A spinning ring system as set forth in claim 16 including second seal means effectively positioned between each of said second end portions and a respective body portion.

18. A spinning ring construction comprising a holder, a spinning ring mounted on said holder, a lubricant block, lubricant feeder means for metering lubricant, first and second end portions on said lubricant feeder means, conduit means in said block for conducting lubricant to said first end portion of said feeder means, a first bore in said lubricant block, said first end portion of said lubricant feeder means being received in said first bore, a second bore in said holder, said second end portion of said feeder means being received in said second bore, fastener means for securing said lubricant block directly to said holder, first conduit means in said lubricant block in communication with said lubricant feeder means for conducting lubricant thereto, and second conduit means in said holder in communication with said second end portion of said lubricant feeder means for conducting lubricant to said spinning ring.

19. A spinning ring construction as set forth in claim 18 wherein said second end of said lubricant feeder means fits into said second bore with a straight plug-in connection.

20. A spinning ring construction as set forth in claim 18 including first sealing means for effecting a first seal between said first end portion of said lubricant feeder means and said block, and second sealing means for effecting a second seal between said second end portion of said lubricant feeder means and said holder.

21. A spinning ring construction as set forth in claim 20 wherein said second end of said lubricant feeder means fits into said second bore with a straight plug-in connection.

22. A spinning ring construction as set forth in claim 20 wherein said means for securing said lubricant block to said holder comprises a plurality of screws spaced from said lubricant feeder means for attaching said lubricant block to said holder.

* * * * *